US007136032B2

(12) United States Patent
Onozawa et al.

(10) Patent No.: US 7,136,032 B2
(45) Date of Patent: Nov. 14, 2006

(54) PLASMA DISPLAY APPARATUS

(75) Inventors: Makoto Onozawa, Kawasaki (JP); Tomokatsu Kishi, Kawasaki (JP); Shigetoshi Tomio, Kawasaki (JP)

(73) Assignee: Fujitsu Hitachi Plasma Display Limited, Kawasaki (JP)

( * ) Notice: Subject to any disclaimer, the term of this patent is extended or adjusted under 35 U.S.C. 154(b) by 477 days.

(21) Appl. No.: 10/205,197

(22) Filed: Jul. 26, 2002

(65) Prior Publication Data

US 2003/0076284 A1 Apr. 24, 2003

(30) Foreign Application Priority Data

Oct. 19, 2001 (JP) ..... 2001-322471

(51) Int. Cl.
*G09G 3/28* (2006.01)

(52) U.S. Cl. ..... 345/60; 345/68; 345/204

(58) Field of Classification Search ..... 345/60–68, 345/204, 41, 42, 211; 315/169.1–169.4
See application file for complete search history.

(56) References Cited

U.S. PATENT DOCUMENTS 5,696,522 A * 12/1997 Iwama ..... 345/60
5,943,030 A * 8/1999 Minamibayashi ..... 345/60
6,140,984 A 10/2000 Kanazawa et al.
6,262,704 B1 * 7/2001 Kurumisawa et al. ..... 345/98
6,531,995 B1 * 3/2003 Ishii et al. ..... 345/67
6,771,240 B1 * 8/2004 Inoue et al. ..... 345/87

FOREIGN PATENT DOCUMENTS

| | | | |
|---|---|---|---|
| EP | 1065 649 A2 | | 1/2001 |
| JP | 7-261699 | | 10/1995 |
| JP | 11-190984 | | 7/1999 |
| JP | 2000-89721 | | 3/2000 |
| JP | 2000-089721 | * | 3/2000 |

* cited by examiner

*Primary Examiner*—Regina Liang
(74) *Attorney, Agent, or Firm*—Staas & Halsey LLP

(57) ABSTRACT

A plasma display apparatus, in which the supply of a sustain pulse can be controlled for each display line and power consumption can be reduced by terminating the supply of the sustain pulse to the display line in the non-display area, has been disclosed. In this plasma display apparatus, a switch circuit is provided respectively on each wiring path of the sustain pulse to each electrode of a first electrode (X electrode) and a second electrode (Y electrode) and it is possible to control whether or not to supply the sustain pulse for each electrode.

6 Claims, 15 Drawing Sheets

PLASMA DISPLAY APPARATUS

BACKGROUND OF THE INVENTION

The present invention relates to a plasma display apparatus. More particularly, the present invention relates to a power saving technique for a plasma display apparatus.

The plasma display apparatus has been put to practical use as a plane display and is a thin display with high luminance. FIG. 1 is a diagram that shows the general configuration of a conventional three-electrode AC-driven plasma display apparatus. As shown schematically, the plasma display apparatus comprises a plasma display panel (PDP) 1 composed of two substrates, between which a discharge gas is sealed, each substrate having plural X electrodes (X1, X2, X3, . . . , Xn) and Y electrodes (Y1, Y2, Y3, . . . , Yn) arranged adjacently, plural address electrodes (A1, A2, A3, . . . , Am) arranged in the intersecting direction thereto, and phosphors arranged at the intersections, an address drive circuit 2 that applies pulses such as an address pulse to the address electrode, an X common drive circuit 3 that applies pulses such as a sustain discharge pulse to the X electrode, a scan circuit 4 that applies pulses such as a scan pulse sequentially to the Y electrode, a Y common drive circuit 5 that supplies pulses such as a sustain discharge pulse to be applied to the Y electrode to the scan circuit 4, and a control circuit 6 that controls each part, and the control circuit 6 further comprises a display data control circuit 7 that contains a frame memory and a drive control circuit 8 composed of a scan drive control circuit 9 and a common drive control circuit 10. As the plasma display apparatus is widely known, more detailed description about the general apparatus is omitted here, but only the X common drive circuit 3, the scan circuit 4, and the Y common drive circuit 5 that relate to the present invention are further described.

FIG. 2 is a diagram that shows an example of the conventional configuration of the X common drive circuit 3, the scan circuit 4, and the Y common drive circuit 5. The plural x electrodes are connected commonly and driven by the X common drive circuit 3. The X common drive circuit 3 comprises a voltage source +Vs, a ground (GND), and output elements (transistors) Q7, Q8, and Q9 provided between −Vwx and the common X electrode terminal. A pulse of a voltage that corresponds to the common X electrode terminal is supplied by turning one of the transistors on and off.

The scan circuit 4 is composed of individual drivers provided for each Y electrode and each individual driver comprises transistors Q1, Q2 and diodes D1, D2 provided in parallel thereto. One end of the transistors Q1, Q2 and the diodes D1, D2 of each individual driver is connected to each Y electrode and the other end is connected commonly to the Y common drive circuit 5. A scan pulse is applied sequentially to the gates of the transistors Q1 and Q2. The Y common drive circuit 5 comprises transistors Q3, Q4, Q5, and Q6 provided between a voltage source +Vs, GND, +Vwy, and −Vy, and the transistors Q3, Q5, and Q6 are connected to the transistor Q1 and the diode D1 and the transistor Q4 is connected to the transistor Q2 and the diode D2.

In the reset period, +Vwy is applied to the Y electrode and −Vwx to the electrode by turning Q5 and Q9 on and other transistors off to produce an entire surface write/erase pulse, and the display cells of the panel 1 are brought into an identical state. At this time, the voltage +Vwy is supplied to the Y electrode via Q5 and D1. In the address period, GND is supplied to the X electrode, GND to the terminal of Q2, and −Vy to the terminal of Q1 by turning Q4, Q6, and Q8 on and other transistors off. Further, a scan pulse, which switches the state in which Q1 is turned off and Q2 is turned on to that in which Q1 is temporarily turned on and Q2 is turned off, is supplied sequentially to the individual drivers. At this time, Q1 is turned on and Q2 is turned off in the individual drivers to which the scan pulse is supplied, therefore, −Vy is supplied to the Y electrode, to which the scan pulse is supplied, via Q1, GND is supplied to other Y electrodes via Q2, and an address discharge is caused to occur between the address electrode to which a positive data voltage is supplied and the Y electrode to which the scan pulse is supplied. In this manner, each cell of the panel is brought into a state in accordance with the display data.

In the sustain discharge period, the pair of Q3 and Q8 and that of Q4 and Q7 are turned on alternately, in the state in which Q1, Q2, Q5, Q6, and Q9 are turned off. By this, +Vs and GND are supplied alternately to the Y electrode and the X electrode and a sustain discharge is caused to occur in the cell in which an address discharge has been caused to occur in the address period, thereby a display is achieved. If Q3 is turned on at this moment, +V1 is supplied to the Y electrode via D1, and if Q4 is turned on, GND is supplied to the Y electrode via D2. In other words, pulses of the voltage Vs of the opposite polarity are supplied alternately between the X electrode and the Y electrode in the sustain discharge period. This pulse is referred to the sustain pulse here.

The above is just one example, and there are various examples of modifications to what kind of voltage is applied in the reset period, the address period, and the sustain discharge period. There are also various examples of modification of the scan circuit 4, the Y common drive circuit 5, and the X common drive circuit 3.

Recently, global warming caused by the emission of carbon dioxide is seen as a problem and it is important to reduce the power consumption of devices that use electricity. Therefore, it is an important point to reduce the power consumption of a plasma display apparatus.

What consumes a large power in a plasma display apparatus is the action to supply a pulse to the electrode of the panel. In particular, a sustain pulse consumes much power because it is applied many times to every X electrode and Y electrode alternately. In the above-mentioned conventional plasma display apparatus, the sustain pulse is supplied to every X electrode and Y electrode regardless of the display state of the screen, that is, regardless whether light is emitted or not. By this, a sustain discharge is caused to occur and light is emitted in the image display area. In the non-display area, on the other hand, a sustain discharge is not caused to occur even though the sustain pulse is supplied to the X electrode and the Y electrode, but a charge/discharge current flows through the panel capacitor because the sustain pulse is supplied, and power is consumed. This means that the power consumption due to the sustain pulse to be supplied to the image display area is necessary for the video display, but that due to the sustain pulse to be supplied to the non-display area is reactive power that does not contribute to the video display.

Japanese Unexamined Patent Publication (Kokai) No. 11-190984 has disclosed the technique to reduce such a reactive power. In this technique, power consumption is reduced by detecting whether or not there exists display data in a single field period and terminating the supply of the sustain pulse in fields and subfields where no display data exists. Furthermore, Japanese Unexamined Patent Publication (Kokai) No. 11-190984 has proposed to control the supply of the sustain pulse for each display line by detecting whether or not there exists display data for each display line. Japanese Unexamined Patent Publication (Kokai) No. 11-190984, however, has neither disclosed nor proposed any concrete configuration with which to control the supply of the sustain pulse for each display line.

As described above, in the conventional plasma display apparatus, the configuration is so designed that the sustain pulse is supplied from the X common drive circuit and the Y common drive circuit and supplied simultaneously to every x electrode or Y electrode. Therefore, it is possible to terminate the supply of the sustain pulse when there is no display data on the entire screen, but it is impossible to control the supply of the sustain pulse for each display line when the display data does not exist only on a part of the screen.

Japanese Unexamined Patent Publication (Kokai) No. 2000-89721 has disclosed the technique in which the luminance is improved by lengthening the sustain period by the time saved by the strategy that the scan pulse is supplied only to the display line that has display data and not supplied to the display line that does not have display data by detecting whether or not there exists display data for each display line. A concrete configuration, however, to control the supply of the scan pulse to each display line has neither disclosed nor proposed. Moreover, there has not been any reference in particular to the supply of the sustain pulse.

On the other hand, Japanese Unexamined Patent Publication (Kokai) No. 7-261699 has disclosed a configuration to reduce power consumption in the interlaced plasma display apparatus, in which two of the common drive circuits are provided respectively so that the pair of the odd-numbered x electrode and Y electrode and the pair of the even-numbered X electrode and Y electrode can be driven alternately, and while the sustain pulse is being supplied from one of the circuits, the output of the other circuit is made to enter the high impedance state. This configuration, however, cannot control the supply of the sustain pulse to the desired X electrode and Y electrode.

As described above, no configuration to control the supply of the sustain pulse for each display line is known concerning the conventional technique and it has been impossible to reduce reactive power consumption due to the sustain pulse supplied to the non-display area.

SUMMARY OF INVENTION

The object of the present invention is to realize a plasma display apparatus that can control the supply of the sustain pulse for each display line and to reduce power consumption by terminating the supply of the sustain pulse to the display line in the non-display area.

In order to realize the above-mentioned object, in the plasma display apparatus of the first aspect of the present invention, a switch circuit is provided on the wiring path of the sustain pulse to each electrode of first electrodes (X electrodes) or second electrodes (Y electrodes) so that it is possible to control whether or not to supply the sustain pulse for each electrode.

In the plasma display apparatus of the second aspect of the present invention, the Y drive circuit that drives the Y electrode comprises plural scan pulse paths to supply the scan pulse to each of the second electrodes and plural sustain pulse paths to supply the sustain pulse to each of the second electrodes, and a switch circuit is provided on each sustain pulse path in order to control supply of the sustain pulse for each electrode.

In the plasma display apparatus of the third aspect of the present invention, the Y drive circuit or the X drive circuit comprises plural line drive switches composed of a high-side switch that supplies a high-potential side pulse to each electrode and a low-side switch that supplies a low-potential side pulse to each electrode and a power source switch that switches the voltages to be supplied to the terminals of the high-side switch and the low-side switch between that which corresponds to the scan pulse and that which corresponds to the sustain pulse, and the supply of the scan pulse and the sustain pulse to each electrode is performed by controlling the plural line drive switches in order to control supply of the scan pulse and the sustain pulse to each electrode.

The plasma display apparatus of the present invention comprises a display area detect circuit that detects the non-display area where no display pixel exists, which is lit in the display line composed of the X electrode and the Y electrode, and the display area where at least one display pixel to be lit exists, in the display area of the display panel, so that no pulse is supplied to the X electrode and the Y electrode in the display line in the non-display area. In this way, power consumption can be reduced.

It is effective to enable control of the supply of the sustain pulse to only one of the X electrode and the Y electrode for each electrode, and power consumption can be reduced accordingly, but if it is enabled to control the supply of the sustain pulse to both of the X electrode and the Y electrode, power consumption can be further reduced.

Although not as large as the power consumption of the sustain pulse, the supply of the reset pulse and the scan pulse also consumes power and the power consumed by the supply of the reset pulse and the scan pulse is also reactive. Therefore, it is also desirable to the control supply of the reset pulse and the scan pulse for each electrode, and such a control can be realized by adding a conventional configuration to supply the reset pulse and the scan pulse to those of the first through the third aspects.

BRIEF DESCRIPTION OF THE DRAWINGS

The features and advantages of the invention will be more clearly understood from the following description taken in conjunction with the accompanying drawings, in which.

DESCRIPTION OF THE PREFERRED EMBODIMENTS

Figure 1:
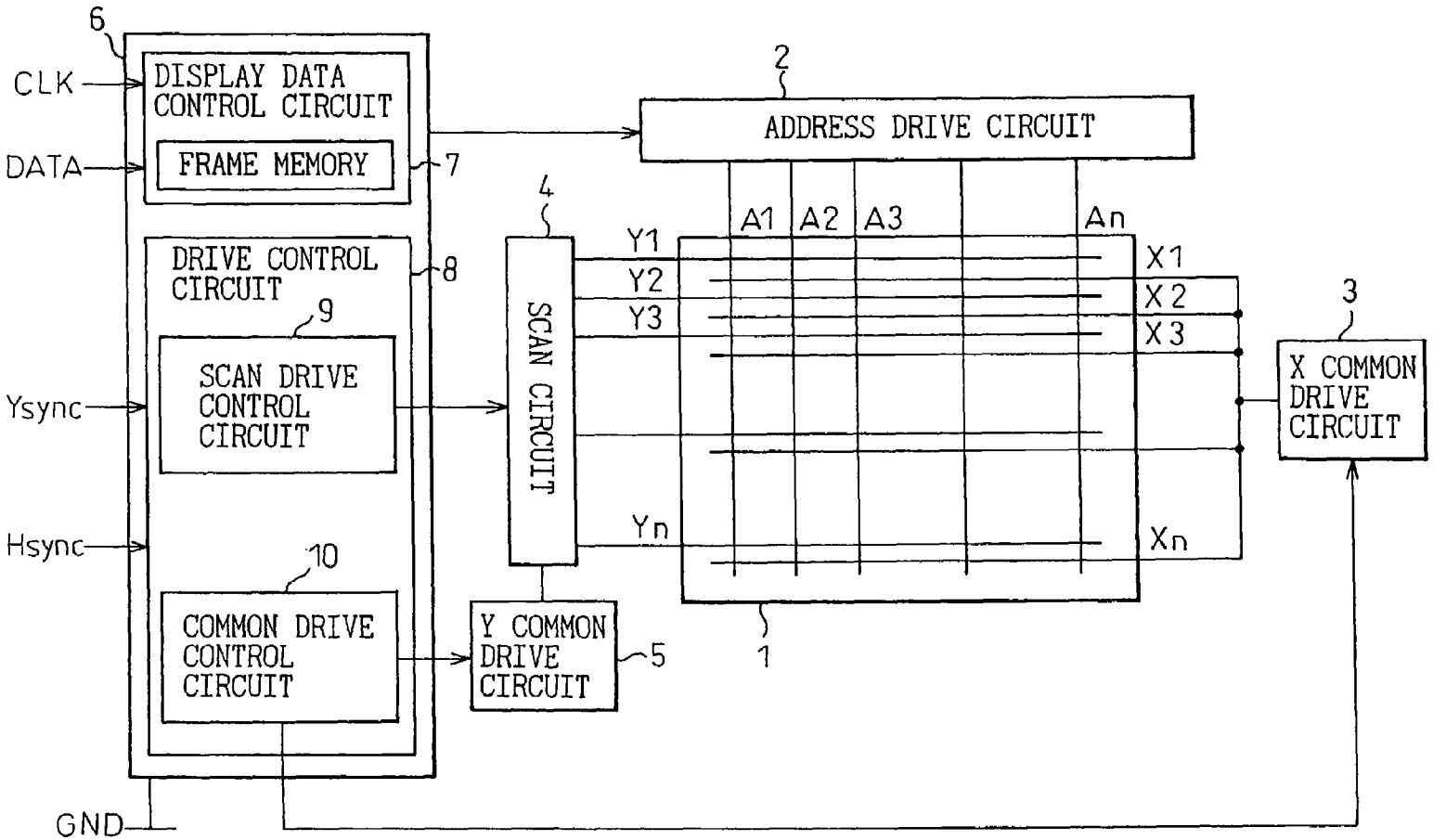
Fig.1 (PRIOR ART)
FIG. 1 is a diagram that shows the general configuration of the conventional plasma display apparatus.
Figure 3:
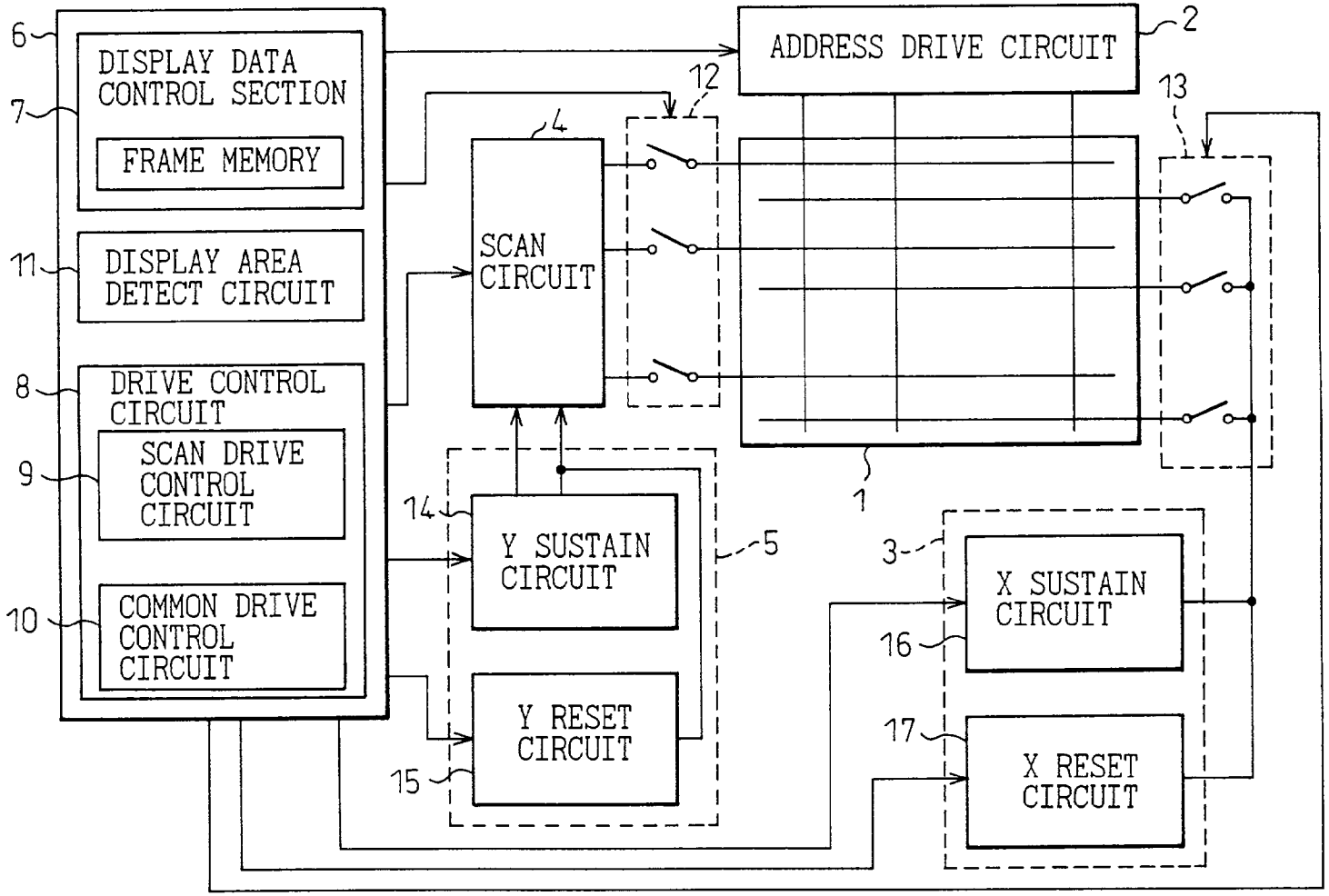
FIG. 3 is a diagram that shows the general configuration of the plasma display apparatus in the first embodiment of the present invention.

FIG. 3 is a block diagram that shows the general configuration of the plasma display apparatus in the first embodiment of the present invention. As is obvious, if compared with FIG. 1, it differs in that a display area detection circuit 11 is provided in the control circuit 6, a Y drive switch 12 is provided on the signal path between each Y electrode and the scan circuit 4, and an X drive switch 13 is provided on the signal path between each X electrode and the X common drive circuit 3. The Y common drive circuit 5 is composed of a Y sustain circuit 14 and a Y reset circuit 15, and the X common drive circuit 3 is composed of an X sustain circuit 16 and an X reset circuit 17, as shown schematically.

The display area detection circuit 11 investigates the frame memory, detects a non-display line that has no display data (cell to be lit) in each display subframe, and informs the control circuit 8 of the position of the non-display line. The control circuit 8 turns the Y drive switch 12 and the X drive switch 13, that correspond to the position of the non-display line, into a cutoff state to control so that the pulse is not supplied to the X electrode and the Y electrode.

Figure 2:
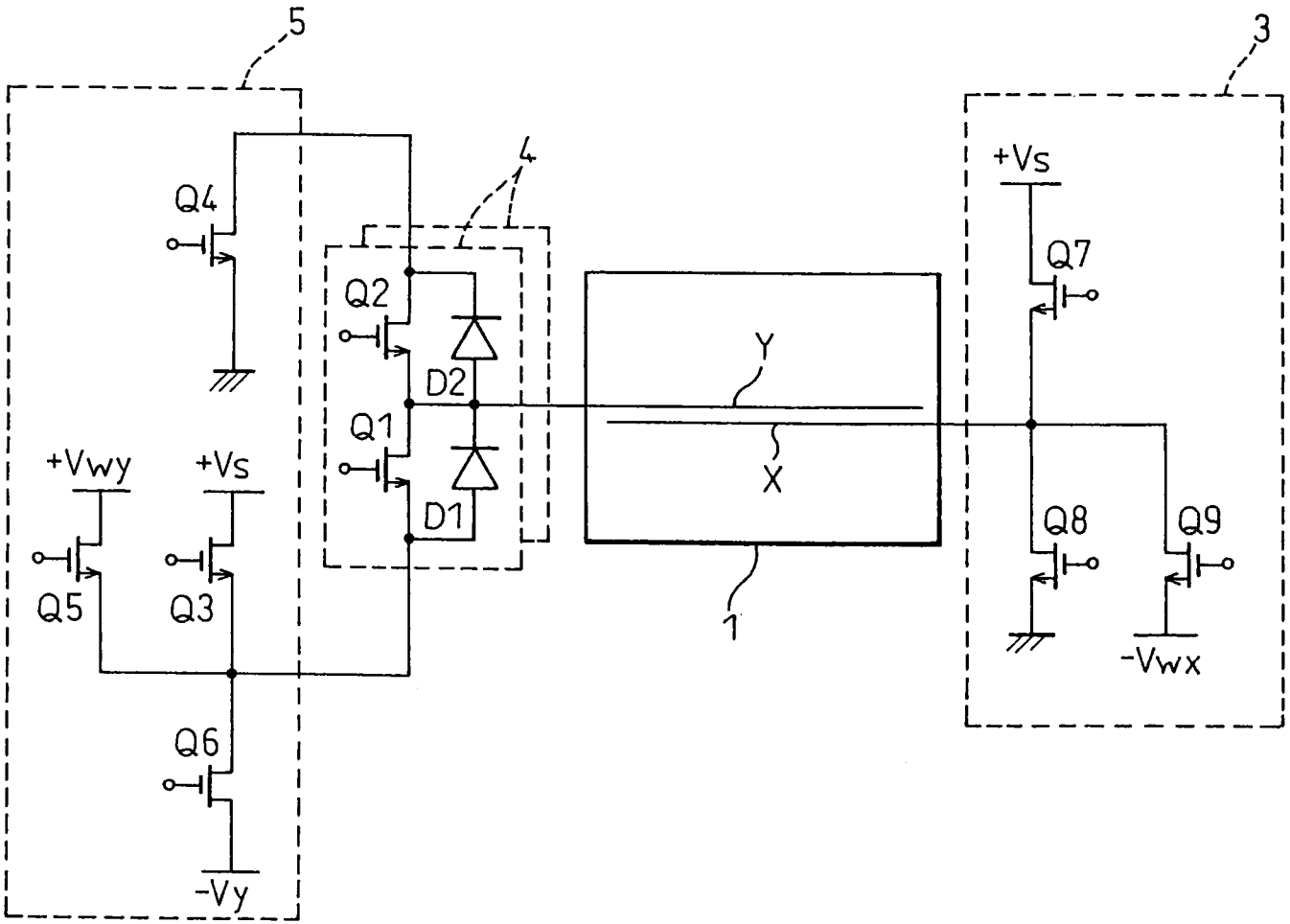
Fig.2 (PRIOR ART)
FIG. 2 is a diagram that shows a conventional example of the X electrode and the Y electrode drive circuits.
Figure 4:
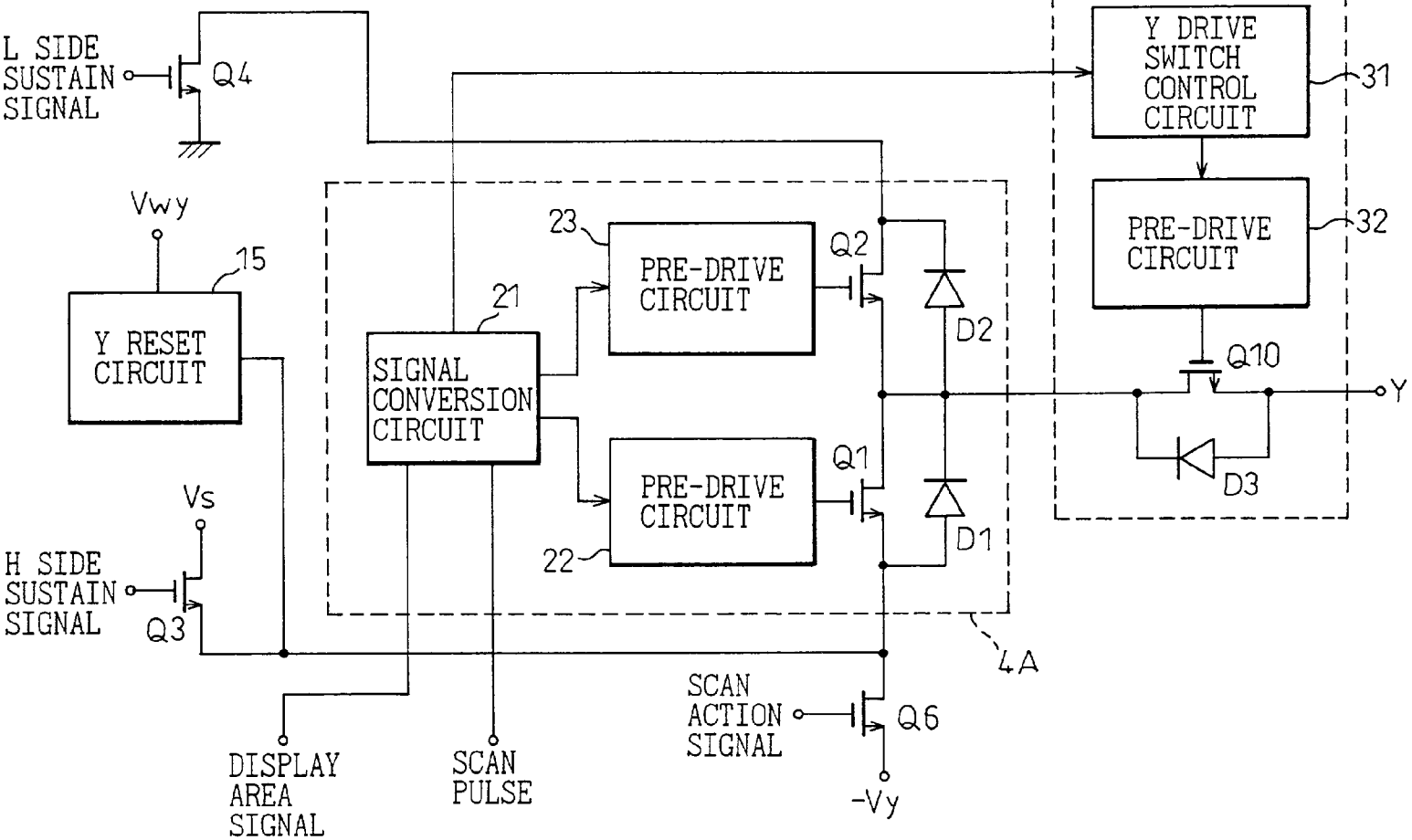
FIG. 4 is a diagram that shows the circuit configuration of the Y drive circuit in the first embodiment.

FIG. 4 is a diagram that shows the circuit configuration of the scan circuit 4, the Y common drive circuit 5, and the Y drive switch 12 of the plasma display apparatus in the first embodiment. Similarly to the conventional example shown in FIG. 2, an individual driver 4A of the scan circuit 4 is provided for each Y electrode, each individual driver comprises the transistors Q1 and Q2, the diodes D1 and D2 provided in parallel thereto, and further comprises pre-drive circuits 22 and 23 of the transistors Q1 and Q2, and a signal conversion circuit 21 that receives the display area signal sent from the control circuit 6 and the scan pulse and generates drive signals to be sent to the pre-drive circuits 22 and 23. Although the transistors Q3, Q4, and Q6 are the same as those of the conventional example in FIG. 2, the Y reset circuit 15 is provided instead of the transistor Q5. This is, as is described later, because a pulse the voltage of which changes gradually is used as a reset signal instead of a rectangular pulse, and the Y reset circuit 15 generates and puts out a reset pulse the voltage of which changes gradually during the reset period, and otherwise brings the output into a high-impedance state. The Y sustain circuit 14 in FIG. 3 corresponds to the parts composed of the transistors Q3 and Q4. The Y sustain circuit 14 and the Y reset circuit 15 are provided commonly in every individual driver 4A.

The first embodiment differs from the conventional example in that an individual Y drive switch 12A is provided on the signal path that connects the individual driver 4A and each Y electrode. Therefore, a number, which is equal to that of the Y electrodes, of the individual Y drive switches 12A are provided. The individual Y drive switch 12A comprises a transistor Q10 provided in series on the signal path, a diode D3 provided in parallel thereto, a Y drive switch control circuit 31 that receives a switch signal from the signal conversion circuit 21 and generates a switch control signal, and a pre-drive circuit 32 that generates a drive signal in accordance with the switch control signal, and the output of the pre-drive circuit 32 is applied to the gate of the transistor Q10. It is desirable that the transistor Q10 is realized by a switching element whose resistance during on state is small such as, for example, an IGBT.

Figure 5:
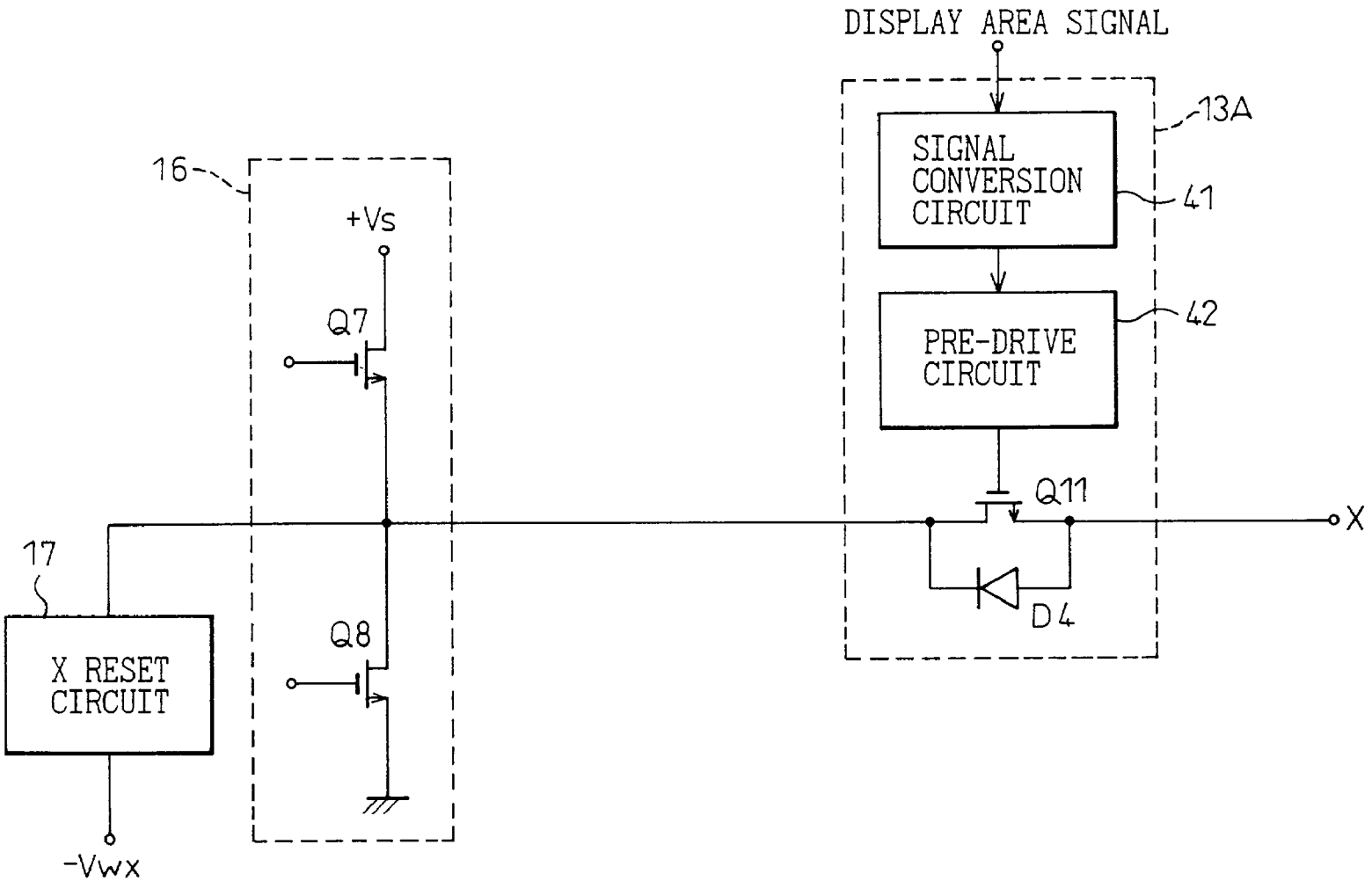
FIG. 5 is a diagram that shows the circuit configuration of the X drive circuit in the first embodiment.

FIG. 5 is a diagram that shows the circuit configuration of the X common drive circuit 3 and an individual X drive switch 13A of the plasma display apparatus in the first embodiment. The X common drive circuit 3 is composed of the X sustain circuit 16 and the X reset circuit 17, and the X sustain circuit 16 is composed of the transistors Q7 and Q8, similarly to the conventional example. The single X common drive circuit 3 is commonly provided to every X electrode. The individual X drive switch 13A is provided for each X electrode, comprising a transistor Q11 provided in series on the signal path to the X electrode, a diode D4 provided in parallel thereto, a signal conversion circuit 41 that receives the display area signal and generates a switch control signal, and a pre-drive circuit 42 that generates a drive signal in accordance with the switch control signal, and the output of the pre-drive circuit 42 is applied to the gate of the transistor Q11.

Figure 6:
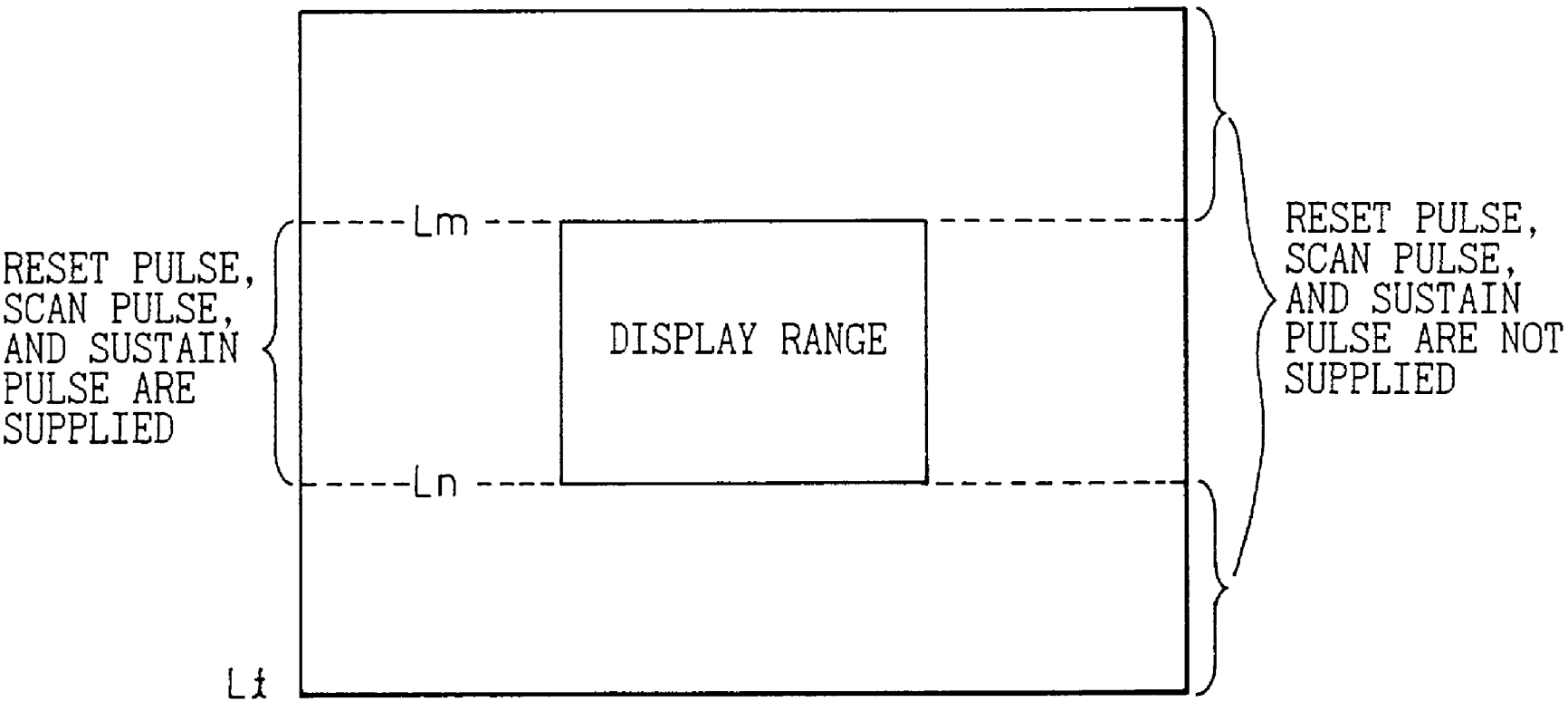
FIG. 6 is a diagram that shows an example of the display area.

FIG. 6 is a diagram that shows an example of a display area detected by the display area detection circuit 11 shown in FIG. 3. As shown in FIG. 6, it is assumed that the range in which display data exists, that is, in which a pixel that emits light exists, is the display range in a screen on a single screen, as shown schematically. The single screen in this case is a display frame, and that is a subframe in the case where gradation display is performed by the subframe structure. In the case of the display range in FIG. 6, the display area detection circuit 11 detects the upper limit line Lm and the lower limit line Ln of the display range and informs the control circuit 8 thereof. The control circuit 8, accordingly, brings into a cutoff state the transistors of the X drive switch 13 and the Y drive switch 12 of the first to the (Lm−1)th and from (Ln+1)th to the Ltth X and Y electrodes, which correspond to the non-display area, during the display.

Figure 7:
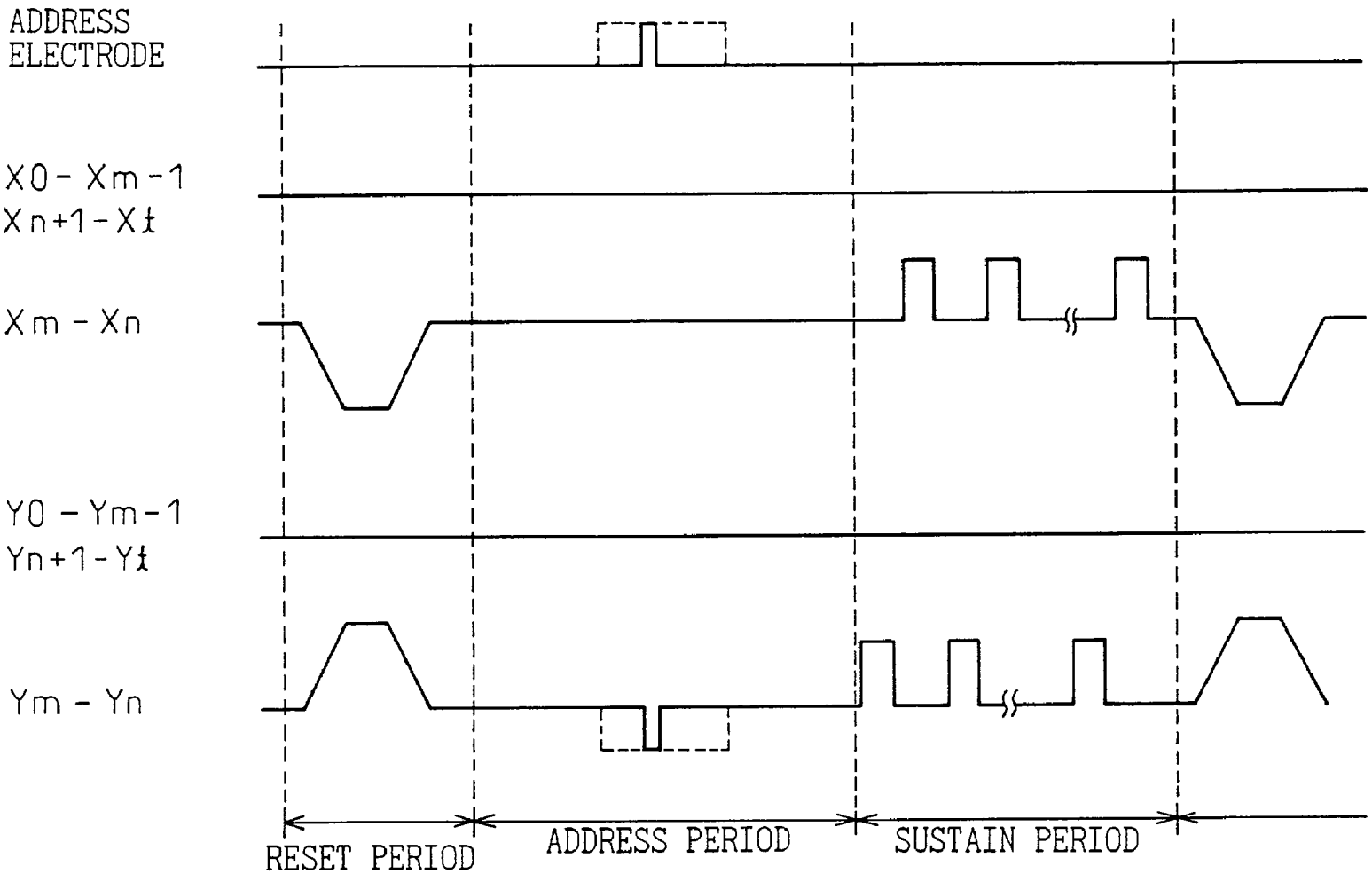
FIG. 7 is a diagram that shows the drive waveforms in the first embodiment.

FIG. 7 is a diagram that shows the drive waveforms in the case of the display area shown in FIG. 6 of the plasma display apparatus in the first embodiment. In the reset period, while the transistors Q1, Q2, Q3, Q4, and Q6 in FIG. 4 and the transistors Q7 and Q8 in FIG. 5 are being kept in cutoff state, a trapezoidal waveform Y reset pulse and an X reset pulse, as shown schematically, are put out from the Y reset circuit 15 and the X reset circuit 17, respectively. As the transistor Q10 of the drive switch to be connected to the Y electrodes (Ym−Yn) in the display area is in conduction state, the Y reset pulse is supplied to the Y electrode in the display area via the diode D1 and the transistor Q10. Similarly, as the transistor Q11 of the drive switch to be connected to the X electrodes (Xm−Xn) is in conduction state, the X reset pulse is supplied to the X electrode in the display area via the transistor Q11. The reset pulse, however, is not supplied to the X electrodes (X0−(Xm−1), (Xn+1)−Xt) and the Y electrodes (Y0−(Ym−1), (Yn+1)−Yt) because the transistor of the drive switch is in cutoff state. Therefore, the number of the electrodes to which the reset pulse is supplied decreases and the number of capacitors to be driven also decreases accordingly, as a result, the power consumption due to the supply of the reset pulse is reduced. Moreover, while the contrast is lowered because the light emission by the reset pulse does not relate to the display, the contrast is improved in the present embodiment because the light emission by the reset pulse is reduced.

In the address period, while the transistors Q3 and Q4 in FIG. 4 and the transistor Q7 in FIG. 5 are being kept in a cutoff state, the transistors Q6 and Q8 are brought into conduction state. Then, while the transistor Q1 is kept in the off state and the transistor Q2 in the on state, the transistor Q1 is temporarily brought into an on state and the transistor Q2 into an off state, and the scan pulse is supplied sequentially and the address pulse is supplied to the address electrode in synchronization with this. The address pulse is supplied only to the address electrode corresponding to the cell that emits light. Since the transistor Q10 of the drive switch to be connected to the Y electrodes (Ym−Yn) in the display area is in conduction state, the scan pulse, which is produced by bringing the transistor Q1 into conduction state, is supplied to the Y electrode in the display area via the transistor Q10. Similarly, the scan pulse is also produced in the non-display area, but the scan pulse is not supplied to the Y electrode in the non-display area because the transistor Q10 is in cutoff state. In this manner, the power consumption due to the supply of the scan pulse is reduced.

In the sustain period, while the transistors Q1, Q2, and Q6 in FIG. 4 are being kept in a cutoff state, the pair of the transistors Q3 and Q8 and the pair transistors Q4 and Q7 are brought into a conduction state alternately to produce the sustain pulse. As the transistor Q10 of the drive switch to be connected to the Y electrodes (Ym−Yn) in the display area is in conduction state, the sustain pulse is supplied to the Y electrode in the display area via the diode D1 and the transistor Q10. Similarly, as the transistor Q11 of the drive switch to be connected to the X electrodes (Xm−Xn) in the display area is in conduction state, the sustain pulse is supplied to the X electrode in the display area via the transistor Q11. The sustain pulse, however, is not supplied to the X electrodes (X0−(Xm−1), (Xn+1)−Xt) and the Y electrodes (Y0−(Ym−1), (Yn+1)−Yt) in the non-display area because the transistor of the drive switch is in cutoff state. In this manner, the power consumption due to the supply of the sustain pulse is reduced.

As described above, the configuration of the plasma display apparatus in the first embodiment is the same as that of the conventional one except in that the drive switch is provided on the signal path to each X electrode and each Y electrode and control is established so that a pulse can be supplied independently to each X electrode and each Y electrode.

The plasma display in the first embodiment has been described above and the configuration is designed in the first embodiment so that neither the reset pulse, the scan pulse, nor the sustain pulse is supplied to the non-display area, but there can be various examples of modification such as that in which only the sustain pulse with a large power consumption is not supplied or that in which neither the reset pulse nor the sustain pulse is supplied.

Moreover, the drive switch is provided on the signal path to the X electrode and the Y electrode in the first embodiment, but it is also possible to provide the drive switch on only one of the paths to the X electrode and the Y electrode.

Figure 8:
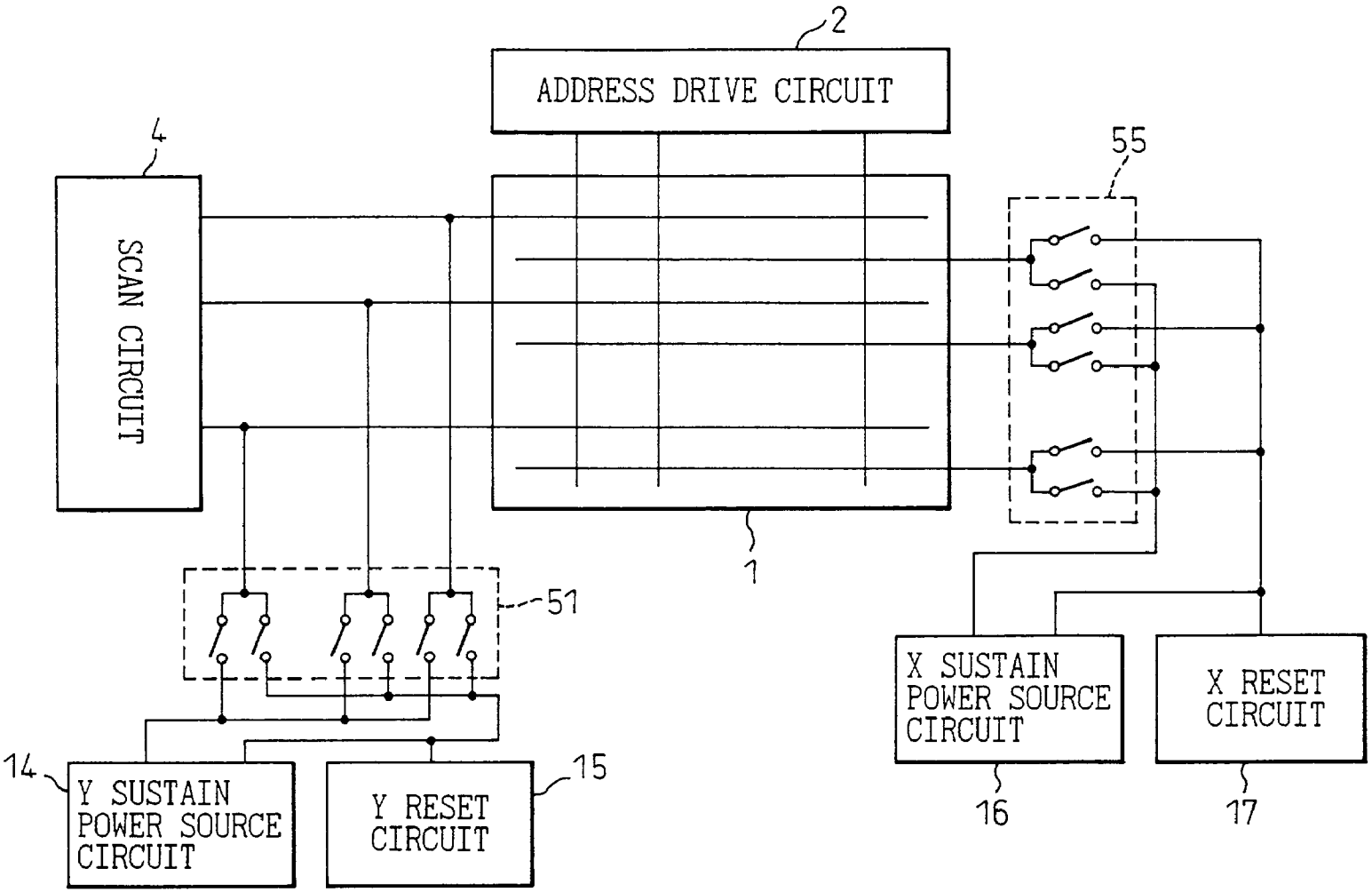
FIG. 8 is a diagram that shows the general configuration of the plasma display apparatus in the second embodiment of the present invention.

FIG. 8 is a block diagram that shows a configuration of the plasma display apparatus in the second embodiment. The plasma display apparatus in the second embodiment differs from the conventional one in that a Y select switch 51 is provided in each Y electrode to control the supply of the Y reset pulse and the sustain pulse and an X select switch 55 is provided in each X electrode to control the supply of the X reset pulse and the sustain pulse. Although not shown here, the display area detection circuit 11 is provided in the control circuit.

Figure 9:
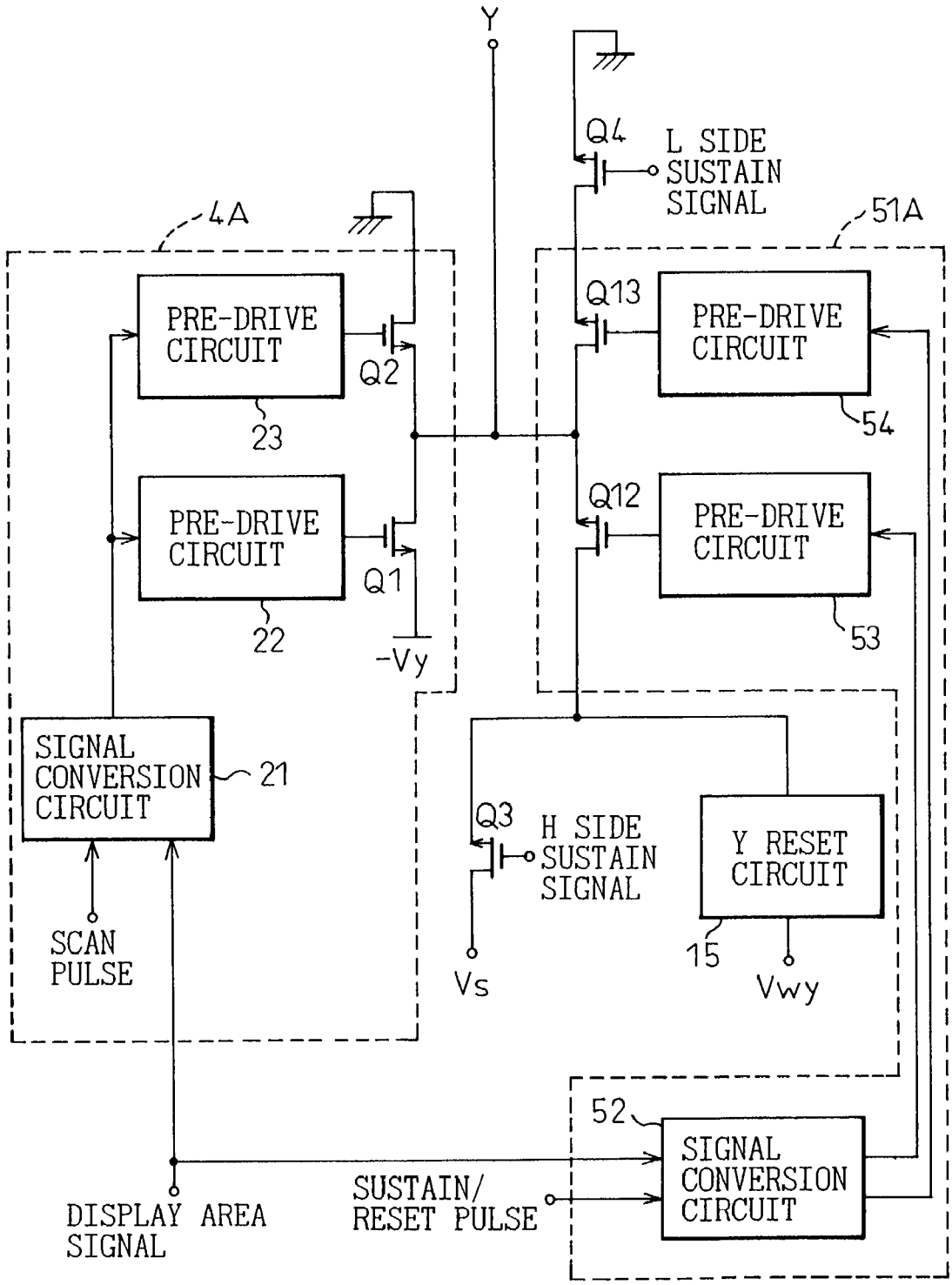
FIG. 9 is a diagram that shows the circuit configuration of the Y drive circuit in the second embodiment.

FIG. 9 is a diagram that shows the configuration of the Y side drive circuit in the second embodiment. The individual driver 4A and an individual Y select switch 51A are connected to each Y electrode. Since the individual driver 4A is the same as that in the first embodiment, a description is omitted here. The individual Y select switch 51A comprises transistors Q12 and Q13, pre-drive circuits 53 and 54 thereof, and a signal conversion circuit 52. The connection node of the transistors Q12 and Q13 is connected to each Y electrode, each of the other node of the transistor Q12 is commonly connected to the Y reset circuit 15 and the transistor Q3, and each of the other node of the transistor Q13 is commonly connected to the transistor Q4.

The signal conversion circuit 52 controls so that the transistors Q12 and Q13 that correspond to the Y electrode in the non-display area are kept in a cutoff state in the reset period, the address period, and the sustain period, and the transistors Q12 and Q13 that corresponds to the Y electrode in the display area are kept in conduction state in the reset period and the sustain period and kept in cutoff state in the address period. In this way, the Y reset pulse produced in the Y reset circuit 15 and the sustain pulse produced by the transistors Q3 and Q4 are supplied to the Y electrode in the display area, but not to the Y electrode in the non-display area.

In addition, the X select switch 55 can be realized by providing the circuit the configuration of which is the same as that of the individual Y select switch 51A shown in FIG. 9 for each X electrode.

The signal conversion circuit 21 controls so that a drive signal that corresponds to the scan pulse is produced only in the display area and not produced in the non-display area. Therefore, the scan pulse is not supplied to the Y electrode in the non-display area. In this case, it is possible to omit the signal conversion circuit 52 and produce the signal to be applied to the pre-drive circuits 53 and 54 in the signal conversion circuit 21.

As described above, in the second embodiment, the reset pulse, the scan pulse, and the sustain pulse are not supplied to the X electrode and the Y electrode in the non-display area, therefore, power consumption is reduced and, simultaneously, the contrast is improved.

Similarly to the first embodiment, there can be various examples of modification for the above-mentioned second embodiment. For example, there can be an example of modification in which the signal conversion circuit 21 produces the scan pulse both in the display area and in the non-display area.

Figure 10:
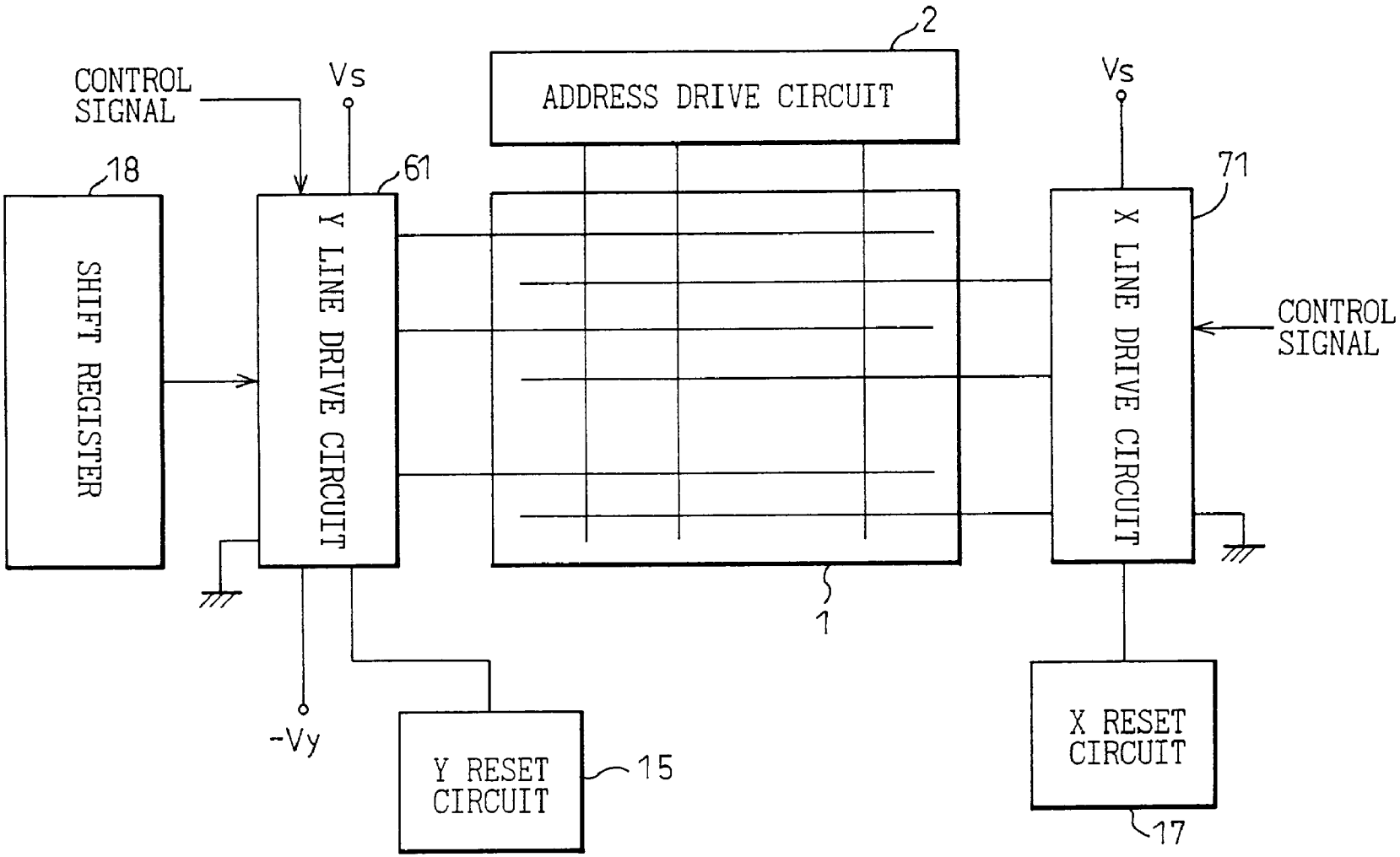
FIG. 10 is a diagram that shows the general configuration of the plasma display apparatus in the third embodiment of the present invention.

FIG. 10 is a block diagram that shows the configuration of the plasma display apparatus in the third embodiment of the present invention. The plasma display apparatus in the third embodiment is characterized in that a Y line drive circuit 61 that can control the independent supply of the reset pulse, the scan pulse, and the sustain pulse to each Y electrode and an X line drive circuit 71, that can control the independent supply of the reset pulse and the sustain pulse to each X electrode, are provided. A shift pulse that corresponds to the scan pulse is supplied from a shift register 18 to the Y line drive circuit 61.

Figure 11:
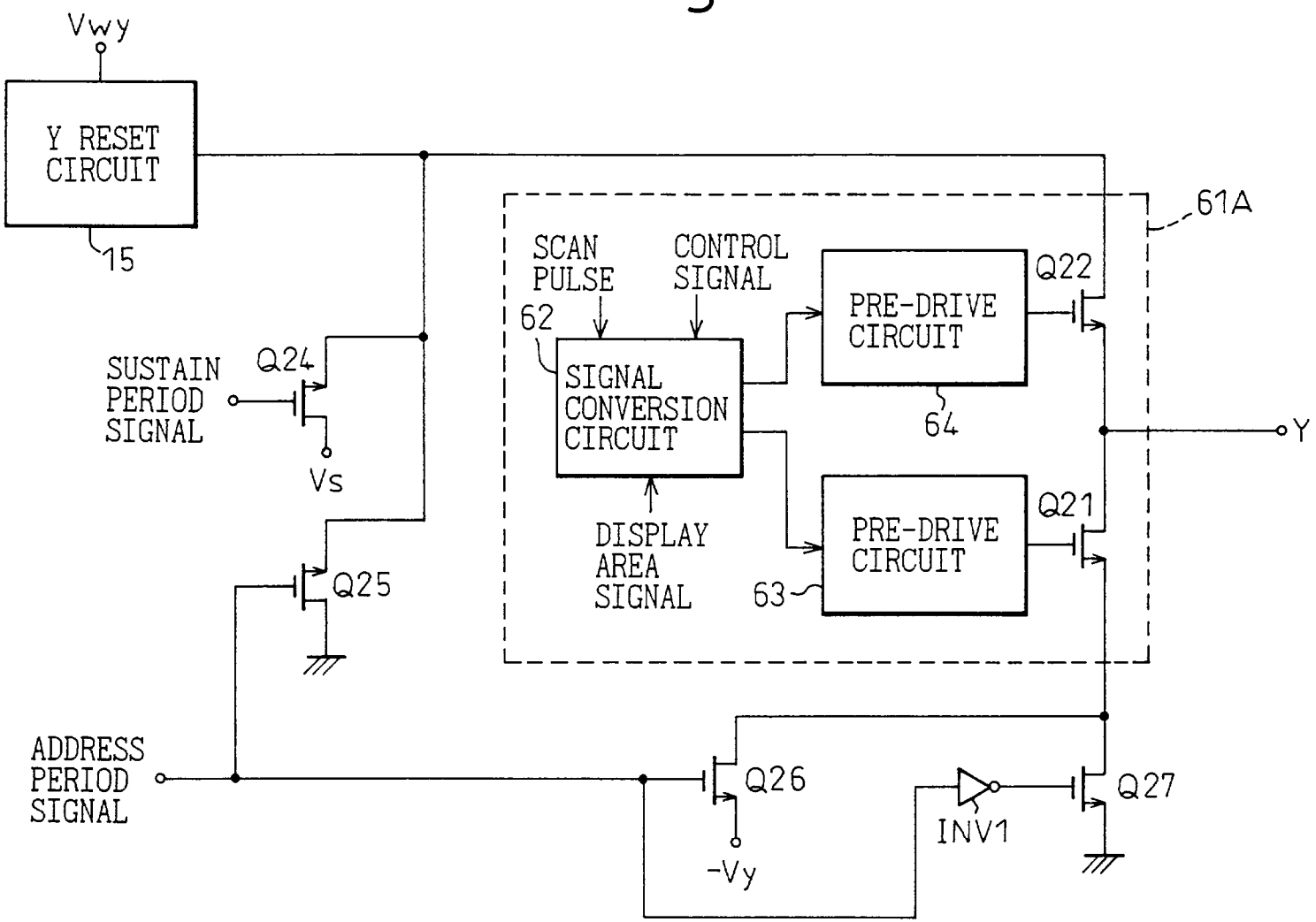
FIG. 11 is a diagram that shows the circuit configuration of the Y drive circuit in the third embodiment.

FIG. 11 is a diagram that shows the circuit configuration of the Y line drive circuit 61. The Y line drive circuit 61 comprises an individual Y drive circuit 61A provided in each Y electrode. The individual Y drive circuit 61A comprises transistors Q21 and Q22, pre-drive circuits 63 and 64, and a signal conversion circuit 62. The signal conversion circuit 62 receives the control signal, the scan pulse, and the display area signal and produces a signal that controls so that the transistors Q21 and Q22 are turned on/off. The transistor Q22 in every individual Y drive circuit 61A is commonly connected to the Y reset circuit 15, commonly connected to the voltage source Vs via a transistor Q24, and commonly connected to the ground via a transistor Q25. The transistor Q21 in every individual Y drive circuit 61A is commonly connected to the power source −Vy via a transistor Q26 and commonly connected to the ground via a transistor Q27.

Figure 12:
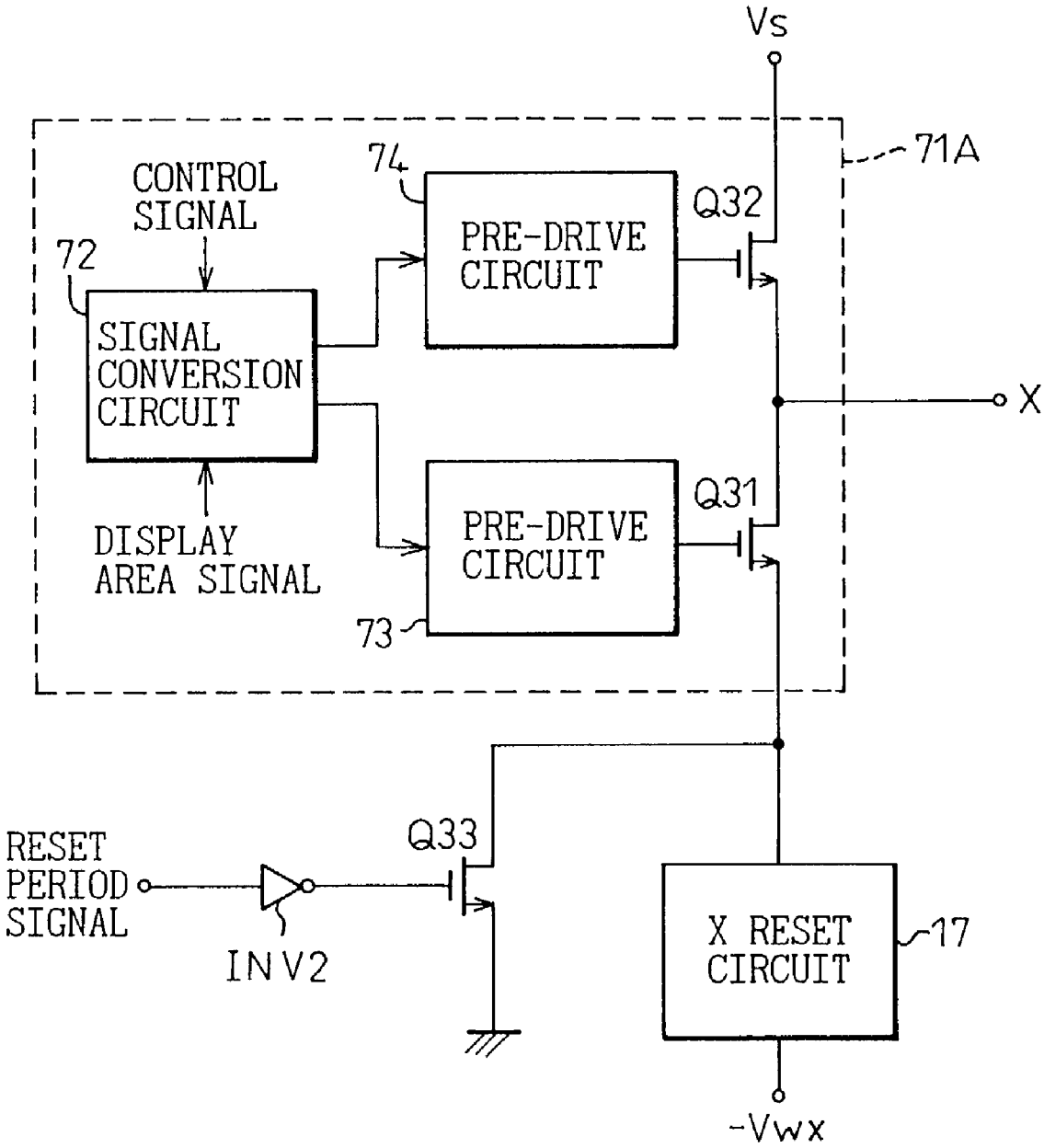
FIG. 12 is a diagram that shows the circuit configuration of the X drive circuit in the third embodiment.

FIG. 12 is a diagram that shows the circuit configuration of an X line drive circuit 71. The X line drive circuit 71 comprises an individual X drive circuit 71A provided in each X electrode. The individual X drive circuit 71A comprises transistors Q31 and Q32, pre-drive circuits 73 and 74, and a signal conversion circuit 72. The signal conversion circuit 62 receives the control signal and the display area signal and produces a control signal that controls so that the transistors Q31 and Q32 are turned on/off. The transistor Q31 in every individual X drive circuit 71A is commonly connected to the X reset circuit 17 and commonly connected to the ground via a transistor Q33. The transistor Q32 in every individual X drive circuit 71A is commonly connected to the power source Vs.

Next, the operations of the plasma display apparatus in the third embodiment are described. In the reset period, the transistors Q21, Q24, Q25, Q26, Q27, Q32, and Q33 are brought into cutoff state, the transistors Q22 and Q31 in the display area are brought into conduction state, the transistors Q22 and Q31 in the non-display area are brought into cutoff state, the reset pulse is put out from the Y reset circuit 15 and the X reset circuit 17, and the reset pulse is supplied to the X electrode and the Y electrode in the display area. Since no reset pulse is supplied to the Y electrode in the non-display area, the power consumption is reduced and simultaneously the contrast is improved.

In the address period, the transistors Q25, Q26, Q31, and Q33 are brought into a conduction state and the transistors Q24, Q27, and Q32 are brought into a cutoff state. In this way, the GND is supplied to every X electrode. Subsequently, after the transistor Q21 in the display area is brought into cutoff state and the transistor Q22 is brought into conduction state, the transistor Q21 is temporarily brought into conduction and the transistor Q22 into cutoff, thereby the scan pulse is supplied sequentially to the Y electrode in the display area. Since the transistors Q21 and Q22 in the non-display area are kept in a cutoff state, the scan pulse is not supplied to the Y electrode in the non-display area. In this way, the power consumption is reduced because the scan pulse is not supplied to the Y electrode in the non-display area.

In the sustain period, the transistors Q24, Q27, and Q33 are brought into conduction state and the transistors Q25 and Q26 are brought into cutoff state. Then the sustain pulse is supplied repeatedly to the X electrode and the Y electrode in the display area by controlling so that the transistors Q21 and Q31 are turned on/off alternately and the transistors Q22 and Q32 are turned on/off alternately in the display area. The transistors Q21, Q22, Q31, and Q32 in the non-display area are kept in cutoff state, therefore, no sustain pulse is supplied to the X electrode and the Y electrode in the non-display area. In this way, the power consumption is reduced because no sustain pulse is supplied to the X electrode and the Y electrode in the non-display area.

The third embodiment is described as above, and there can be various examples of a modification also in the third embodiment.

Although the first through the third embodiments are those of the apparatus in which every display line is displayed simultaneously, an apparatus such as a TV receiver employs the display method called the interlaced method in which odd-numbered display lines and even-numbered display lines are displayed by turns. Japanese Patent No. 2801893 has disclosed a PDP apparatus that employs the interlaced method called the ALIS method in which the number of display lines is doubled using the same number as the conventional one of the sustain discharge electrodes. next, a fourth embodiment, in which the present invention is applied to the plasma display apparatus that employs the ALIS method, is described.

Figure 13:
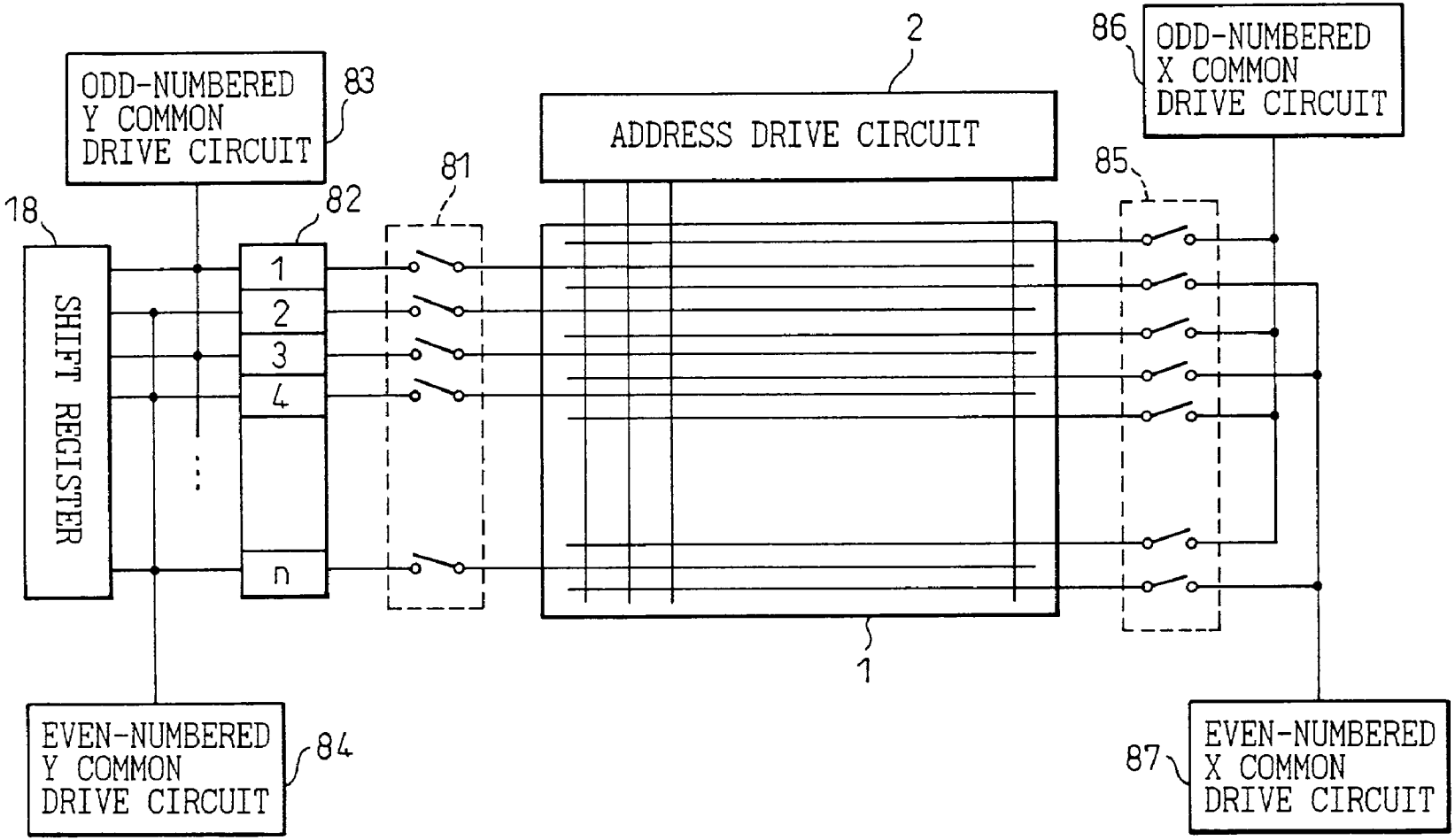
FIG. 13 is a diagram that shows the general configuration of the plasma display apparatus in the fourth embodiment of the present invention.

FIG. 13 is a block diagram that shows the ALIS method plasma display apparatus in the fourth embodiment of the present invention. In FIG. 13, the panel 1, the address drive circuit 2, the shift register 18, a scan circuit 82, an odd-numbered Y common drive circuit 83, an even-numbered Y common drive circuit 84, an odd-numbered X common drive circuit 86, and an even-numbered X common drive circuit 87 are the same as those of the conventional ALIS method plasma display apparatus. In the fourth embodiment, similarly to the first embodiment, a Y drive switch 81 is provided on the signal path to each Y electrode and an X drive switch 85 is provided on the signal path to each X electrode. The Y drive switch 81 and the X drive switch 85 have the same configuration as that of the first embodiment. In this way, the supply of a pulse to each Y electrode and X electrode can be independently controlled, therefore, the supply of reset pulse, scan pulse, and sustain pulse to the Y electrode and the X electrode in the non-display area can be terminated to reduce the power consumption and in addition improve the contrast.

Although the configuration of the first embodiment is applied to the ALIS method plasma display apparatus in the fourth embodiment as shown in FIG. 13, the configuration of the second and the third embodiments can be also applied.

In the ALIS method plasma display apparatus, a large voltage is prevented from being applied between electrodes of non-display lines in order not to cause a discharge to occur in a non-display line adjacent to a display line. Therefore, if the supply of pulse to an electrode in the non-display area is terminated, it may happen that a large voltage is applied between the electrode and an adjacent electrode in the display area even though in a non-display line. Normally, it is possible to specify settings to avoid the occurrence of a discharge in a non-display line even under such a condition and, in such a case, all that is required is to terminate the supply of pulse to the electrode in the non-display area, similarly to the first through the third embodiments. This method, however, reduces the discharge margin, causing a problem concerning the stability of operations. Therefore, a drive method that does not degrade the discharge margin is employed in the fourth embodiment.

Figure 14:
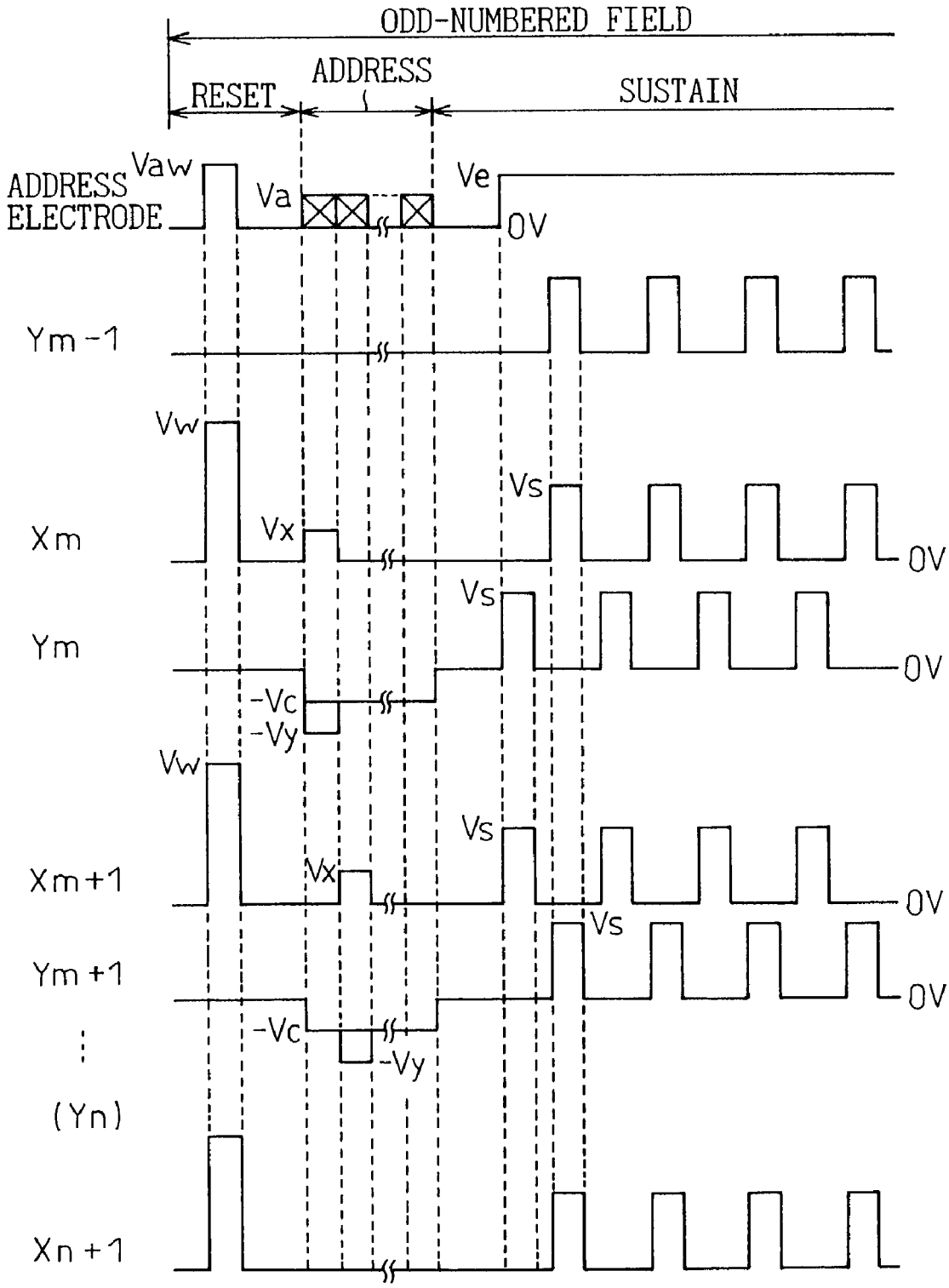
FIG. 14 is a diagram that shows the drive waveforms (odd-numbered field) in the fourth embodiment.
Figure 15:
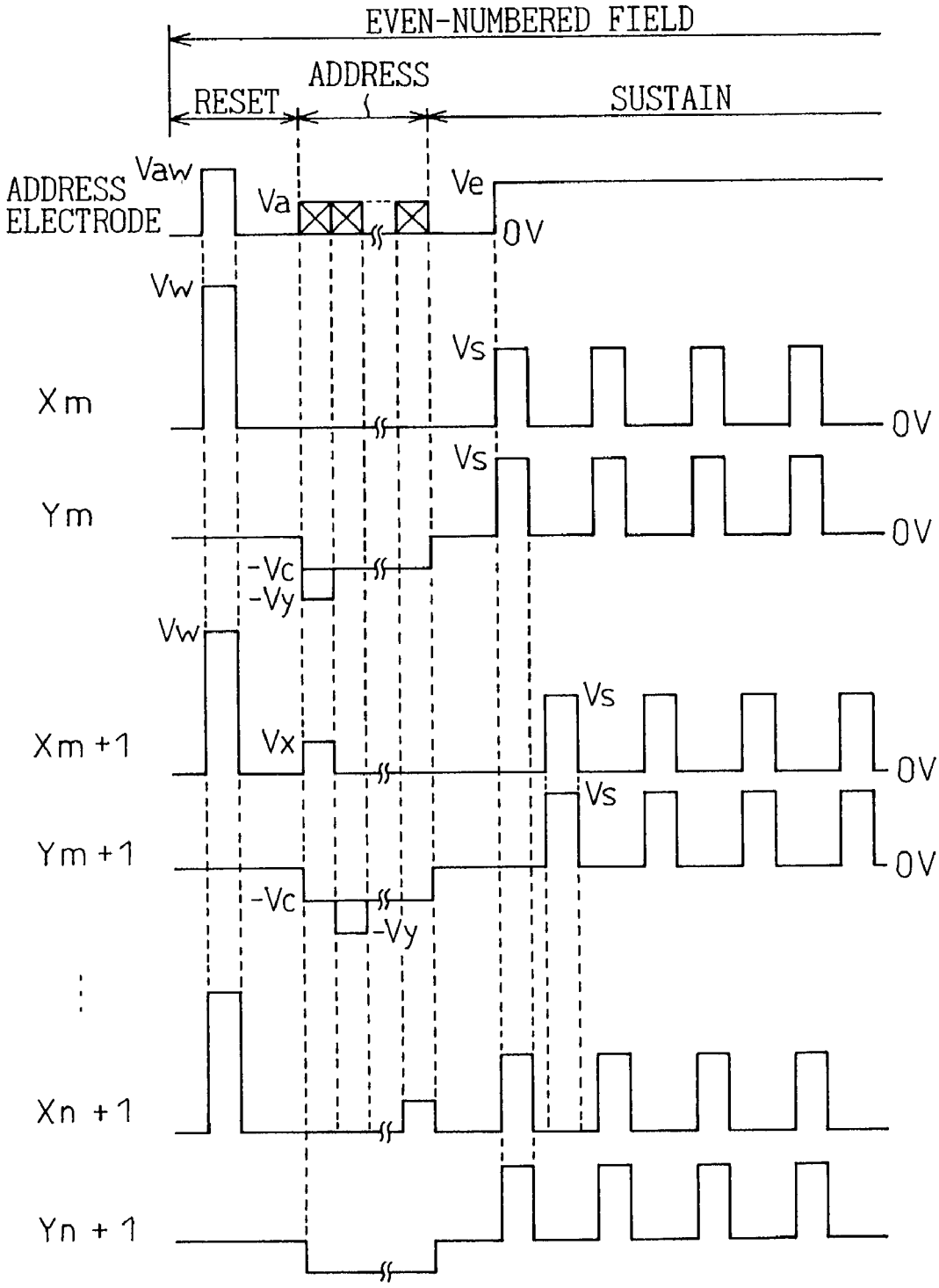
FIG. 15 is a diagram that shows the drive waveforms (even-numbered field) in the fourth embodiment.

FIG. 14 and FIG. 15 are diagrams that show the drive waveforms of the plasma display apparatus in the fourth embodiment, and FIG. 14 shows the drive waveforms in an odd-numbered field and FIG. 15 shows those in an even-numbered field. The display area is assumed to be between rows 2*m* and 2*n*, where m is an odd number and n is an even number. Therefore, in an odd-numbered field, a discharged is caused to occur between the mth X electrode Xm and the mth Y electrode Ym, between Xm+1 and Ym+1, . . . , and between Xn and Yn, and in an even-numbered field, a discharge is caused to occur between Ym and Xm+1, between Ym+1 and Xm+2, . . . , and between Ym and Xn+1.

As shown in FIG. 14, in the reset period in an odd-numbered field, the voltage Vaw is supplied to every address electrode, and with a state in which 0V is supplied to every Y electrode, X1 through Xm−1, and Xn+2 through Xt+1, the reset pulse of voltage Vw is supplied to Xm through Xn+1, thereby a reset discharge is caused to occur in the display lines between rows 2*m*−1 and 2*n*. Resetting is not necessary in an odd-numbered field because the display line of row 2*n* is not displayed, but it is necessary to cause a reset discharge to occur in a non-display line adjacent to the display range because the non-display line affects the display range.

In the address period, in a state in which 0V is supplied to the X electrodes (from X1 to Xm−1 and from Xn+1 to Xt+1) and the Y electrodes (from Y1 to Ym−1 and from Yn+1 to Yt) in the non-display area, 0V is supplied to the X electrodes (from Xm to Xn) in the display area, and −Vc is supplied to the Y electrodes (from Ym to Yn) in the display area, the scan pulses of Vx and −Vy are sequentially supplied to the pairs of the X electrode and the Y electrode in the display area, and in synchronization with this, the address pulse is supplied to the address electrode. In other words, VX and −Vy are sequentially supplied to Xm and Ym, Xm+1 and Ym+1, and so on and, after being supplied to Xn and Yn, the supply is terminated.

In the sustain period, with a state in which the voltage Ve is supplied to the address electrode and 0V is supplied to from X1 to Xm−1, from Xn+2 to Xt+1, and from Y1 to Ym−2, from Yn+1 to Yt, the sustain pulse of voltage Vs is supplied alternately to the pair of an even-numbered X electrode from Xm to Xn+1 and an odd-numbered Y electrode from Ym−1 to Yn, and the pair of an odd-numbered X electrode and an even-numbered Y electrode, thereby the sustain discharge is caused to occur. Although the display lines formed between Ym−1 and Xm belong to the non-display area and the display lines formed between Yn and Xn+1 are those which are not displayed in an odd-numbered field, the sustain pulse of opposite phase is supplied to prevent the charges concerning the sustain discharge between the adjacent Xm and Yn from diffusing to Yn and Xn+1.

As described above, the drive waveforms in the odd-numbered field are almost the same as conventional ones in the fourth embodiment, but the difference from the conventional example exists in that the reset pulse, the scan pulse and the sustain pulse are not supplied to the X electrodes (from X1 to Xm−1 and fron Xn+2 to Xt+1) and the Y electrodes (from Y1 to Ym−2 and from Yn+1 to Yt) in the non-display area and the sustain pulse is supplied to the Y electrode (Ym−1) in the non-display area adjacent to the display area.

In the case of the drive waveforms in the even-numbered field, similarly to those in the odd-numbered field, the difference from the conventional example exists in that the reset pulse, the scan pulse, and the sustain pulse are not supplied to the X electrodes (from X1 to Xm−1 and from Xn+2 to Xt+1) and the Y electrodes (from Y1 to Ym−2 and from Yn+2 to Yt) in the non-display area and the sustain pulse is supplied to the Y electrode (Yn+1) in the non-display area adjacent to the display area.

In both the methods, it is possible to reduce the power consumption because the supply of pulse to the non-display area, where display is not performed, is terminated.

Although the embodiments of the present invention are described above, the present invention is not limited to those but there can be various examples of modifications.

As described above, the plasma display apparatus of the present invention has a configuration in which the supply of pulse to the Y electrode or the X electrode can be independently terminated. Therefore, it is possible to design so as to supply various kinds of operation pulses only to the Y electrode and the X electrode that correspond to the screen display area and not to supply at least part of the pulses to the Y electrode or the X electrode or to both, whereby the power consumption can be reduced accordingly. Moreover, if the supply of the reset pulse that does not relate to the display is terminated, the contrast is improved.

We claim:

1. A plasma display apparatus, comprising:

a display panel that has first electrodes and second electrodes arranged adjacent to each other and third electrodes that intersect the first electrodes and the second electrodes, display pixels being formed at the intersections;

an X drive circuit that drives the first electrodes;

a Y drive circuit that drives the second electrodes, wherein the Y drive circuit comprises:

plural line drive switches respectively arranged in correspondence with said second electrodes, each line drive being composed of a pair of a high-side switch that supplies a high-potential side pulse to each of the second electrode and a low-side switch that supplies a low-potential side pulse to each of the second electrode, a first power source switch that switches the voltages to be supplied to the terminal of the high-side switch between that which corresponds to the scan pulse and that which corresponds to the sustain pulse, and a second power source switch that switches the voltages to be supplied to the terminal of the low-side switch between that which corresponds to the scan pulse and that which corresponds to the sustain pulse, the supply of the scan pulse and the sustain pulse to the second electrodes being controlled by switching the plural line drive switches; and a display area detection circuit which detects a non-display area, in which no display pixel to be lit on the first electrode and the second electrode exists, and a display area, in which at least one display pixel to be lit on the first electrode and the second electrode exists in the display area of the display panel, the Y drive circuit, further, controlling the plural line drive switches so that the sustain pulse is not supplied to the second electrode in the non-display area.

2. A plasma display apparatus as set forth in claim 1, wherein the Y drive circuit controls the plural line drive switches so that the scan pulse is also not supplied to the second electrode in the non-display area.

3. A plasma display apparatus as set forth in claim 1, wherein the Y drive circuit comprises a reset power source switch that switches the voltage to be supplied to the terminals of the high-side switch and the low-side switch to that which corresponds to a reset pulse, and the Y drive circuit controls the plural line drive switches so that the reset pulse is not supplied to the second electrode in the non-display area.

4. A plasma display apparatus as set forth in claim 1, wherein the X drive circuit comprises plural X line drive switches composed of an X high-side switch that supplies a high-potential side pulse to each of the first electrode and an X low-side switch that supplies a low-potential side pulse to each of the first electrode and an X power source switch that switches the voltages to be supplied to the terminals of the high-side switch and the low-side switch between that which corresponds to the sustain pulse and that which corresponds to the reset pulse, the supply of the sustain pulse and the reset pulse to the first electrode is performed by controlling the plural X line drive switches, and it is possible to control whether or not to supply the sustain pulse and the reset pulse to each of the first electrodes.

5. A plasma display apparatus as set forth in claim 4, wherein the X drive circuit controls the plural X line drive switches so that the sustain pulse is not supplied to the first electrode in the non-display area.

6. A plasma display apparatus as set forth in claim 5, wherein the X drive circuit comprises an X reset power source switch that switches the voltage to be supplied to the terminals of the X high-side switch and the X low-side switch to that which corresponds to a reset pulse, and the X drive circuit controls the plural X line drive switches so that the reset pulse is not supplied to the first electrode in the non-display area.

* * * * *